US011131217B2

(12) United States Patent
Murakami et al.

(10) Patent No.: US 11,131,217 B2
(45) Date of Patent: Sep. 28, 2021

(54) STEAM TURBINE EXHAUST CHAMBER AND STEAM TURBINE

(71) Applicant: Mitsubishi Hitachi Power Systems, Ltd., Yokohama (JP)

(72) Inventors: Ryo Murakami, Tokyo (JP); Kazuyuki Matsumoto, Tokyo (JP); Yoshihiro Kuwamura, Tokyo (JP); Toyoharu Nishikawa, Tokyo (JP); Soichiro Tabata, Yokohama (JP)

(73) Assignee: MITSUBISHI POWER, LTD., Yokohama (JP)

( * ) Notice: Subject to any disclaimer, the term of this patent is extended or adjusted under 35 U.S.C. 154(b) by 61 days.

(21) Appl. No.: 16/493,143

(22) PCT Filed: Mar. 30, 2018

(86) PCT No.: PCT/JP2018/013530
§ 371 (c)(1),
(2) Date: Sep. 11, 2019

(87) PCT Pub. No.: WO2018/181855
PCT Pub. Date: Oct. 4, 2018

(65) Prior Publication Data

US 2020/0011206 A1 Jan. 9, 2020

(30) Foreign Application Priority Data

Mar. 30, 2017 (JP) ..... JP2017-069366

(51) Int. Cl.
*F01D 25/30* (2006.01)
*F01D 1/02* (2006.01)

(52) U.S. Cl.
CPC ..... *F01D 25/30* (2013.01); *F01D 1/02* (2013.01); *F05D 2220/31* (2013.01); *F05D 2240/12* (2013.01)

(58) Field of Classification Search
CPC ..... F01D 25/30; F01D 1/02
(Continued)

(56) References Cited

U.S. PATENT DOCUMENTS 5,209,634 A 5/1993 Owczarek
5,257,906 A * 11/1993 Gray ..... F01D 25/30 415/226

(Continued)

FOREIGN PATENT DOCUMENTS

JP 54-47908 A 4/1979
JP 08260904 A * 10/1996

(Continued)

OTHER PUBLICATIONS

JP 08260904A English Translation (Year: 1996).*

(Continued)

*Primary Examiner* — Shafiq Mian
(74) *Attorney, Agent, or Firm* — Westerman, Hattori, Daniels & Adrian, LLP

(57) ABSTRACT

A steam turbine exhaust chamber includes a casing and a bearing cone disposed in the casing. The casing has a recess provided along at least a part of a circumference of the casing on a radially outer side of a downstream end of the bearing cone and recessed downstream in an axial direction with respect to the downstream end of the bearing cone.

18 Claims, 9 Drawing Sheets

(58) Field of Classification Search
USPC ..... 415/226, 211.2, 225
See application file for complete search history.

(56) References Cited

U.S. PATENT DOCUMENTS

| | | | | |
|---|---|---|---|---|
| 6,261,055 | B1 * | 7/2001 | Owczarek | F01D 1/02 415/148 |
| 6,419,448 | B1 * | 7/2002 | Owczarek | F01D 1/02 415/207 |
| 2019/0277139 | A1 * | 9/2019 | Matsumoto | F01D 25/26 |

FOREIGN PATENT DOCUMENTS

| | | | |
|---|---|---|---|
| JP | H8-260904 | A | 10/1996 |
| JP | H11-200814 | A | 7/1999 |
| JP | 2003-027905 | A | 1/2003 |
| JP | 2006-83801 | A | 3/2006 |
| JP | 2006-329148 | A | 12/2006 |
| JP | 2007-291855 | A | 11/2007 |
| JP | 4541813 | B2 | 9/2010 |
| JP | 2011-220125 | A | 11/2011 |

OTHER PUBLICATIONS

The Office Action dated Jun. 23, 2020, issued in counterpart JP application No. 2019-510216, with English Translation. (6 pages).
Office Action dated Sep. 18, 2020, issued in counterpart in Application No. 201917035681, with English translation (5 pages).
Extended Search Report dated Nov. 10, 2020, issued in counterpart EP Application No. 18776032.7 (8 pages).
Notification of Transmittal of Translation of the International Preliminary Report on Patentability (Forms PCT/IB/326) issued in counterpart International Application No. PCT/JP2018/013530 dated Oct. 10, 2019 with Forms PCT/IB/338, PCT/IB/373 and PCT/ISA/237. (12 pages).
International Search Report dated May 29, 2018, issued in counterpart Application No. PCT/JP2018/013530, with English translation. (8 pages).

* cited by examiner

STEAM TURBINE EXHAUST CHAMBER AND STEAM TURBINE

TECHNICAL FIELD

The present disclosure relates to a steam turbine exhaust chamber and a steam turbine.

BACKGROUND ART

Steam from a turbine casing of a steam turbine is generally discharged from the steam turbine through an exhaust chamber. In the exhaust chamber, fluid loss occurs depending on the characteristics of steam flow and the shape of an internal structure. Therefore, configurations for reducing fluid loss in the exhaust chamber have been proposed.

For instance, Patent Document 1 discloses a steam turbine including a deflection member disposed on a flow guide which forms a diffuser passage of an exhaust chamber, so that swirl is imparted to a tip flow in the diffuser passage to reduce loss caused when the tip flow is mixed with a steam main flow.

Patent Document 2 discloses a low-pressure exhaust chamber of a stream turbine including a steam guide and a bearing cone which together form an exhaust passage, in which a part of the bearing cone is curved toward a rotor to increase an exhaust passage area and smooth the flow of steam passing through the exhaust passage.

Patent Document 3 discloses an exhaust device for a steam turbine which discharges steam downward from an exhaust chamber. In this exhaust chamber, a steam passage formed by a flow guide on the outer peripheral side and a bearing cone on the inner peripheral side has an upstream portion and a downstream portion longer than the upstream portion.

CITATION LIST

Patent Literature

Patent Document 1: JP2011-220125A
Patent Document 2: JP2006-83801A
Patent Document 3: JPH11-200814A

SUMMARY

Problems to be Solved

The steam turbine, the low-pressure exhaust chamber, and the exhaust device disclosed in Patent Documents 1 to 3 are expected to reduce fluid loss in the exhaust chamber by the shape of the deflection member and the bearing cone disposed in the exhaust chamber or the shape of the steam passage formed by the flow guide and the bearing cone.

However, a further measure for reducing fluid loss in the exhaust chamber of the steam turbine is desired. In particular, operation at low load tends to increase fluid loss in the exhaust chamber compared with normal operation.

In view of the above, an object of at least one embodiment of the present invention is to provide a steam turbine exhaust chamber and a steam turbine whereby it is possible to reduce fluid loss in the exhaust chamber.

Solution to the Problems (1) A steam turbine exhaust chamber according to at least one embodiment of the present invention comprises: a casing; and a bearing cone disposed in the casing, and the casing has a recess provided along at least a part of a circumference of the casing on a radially outer side of a downstream end of the bearing cone and recessed downstream in an axial direction with respect to the downstream end of the bearing cone.

With the above configuration (1), in the exhaust chamber of the steam turbine including the casing with the recess, even when the steam is biased to the flow guide and forms the backflow near the bearing cone for instance at low-load operation, the recess guides the backflow. Thus, it is possible to prevent the backflow from flowing upstream of the bearing cone, and it is possible to reduce expansion of a circulation region, where circulation flow including the backflow circulates, upstream of the downstream end of the bearing cone. Thus, it is possible to suppress separation of the steam at the bearing cone and prevent a decrease in effective exhaust area in the exhaust chamber, and it is possible to improve pressure recovery amount of the steam in the exhaust chamber Consequently, it is possible to reduce fluid loss in the exhaust chamber, and it is possible to improve the efficiency of the steam turbine.

(2) In some embodiments, in the above configuration (1), the recess includes a first recess having: a radial wall surface positioned downstream of the downstream end of the bearing cone in the axial direction and extending along a radial direction; and an axial wall surface connected at a first end to a radially inner end of the radial wall surface and extending in a direction intersecting the radial direction from the first end to a second end.

With the above configuration (2), the first recess has the radial wall surface extending along the radial direction on the downstream side of the downstream end of the bearing cone with respect to the axial direction and the axial wall surface connected at the first end to the radially inner end of the radial wall surface and extending in a direction intersecting the radial direction from the first end to the second end. Since such an axial wall surface can guide the backflow flowing upstream along the radial wall surface so as not to flow further upstream, it is possible to suppress separation of the steam at the bearing cone.

(3) In some embodiments, in the above configuration (2), the axial wall surface is disposed along the axial direction.

With the above configuration (3), since the axial wall surface is disposed along the axial direction, it is possible to guide the backflow flowing upstream along the radial wall surface so as not to flow further upstream. Thus, it is possible to suppress separation of the steam at the bearing cone.

(4) In some embodiments, in the above configuration (2), the first end of the axial wall surface is positioned on an inner side of the second end of the axial wall surface in the radial direction.

With the above configuration (4), since the first end of the axial wall surface connected to the radially inner end of the radial wall surface is positioned on the radially inner side of the second end, it is possible to more effectively guide the backflow flowing upstream along the radial wall surface so as not to flow further upstream, compared with the case where the axial wall surface is disposed along the axial direction. Thus, it is possible to more effectively suppress separation of the steam at the bearing cone.

(5) In some embodiments, in the above configuration (1), the recess includes a second recess having a curved wall surface curved and positioned downstream of the downstream end of the bearing cone in the axial direction.

With the above configuration (5), the second recess has the curved wall surface curved downstream of the downstream end of the bearing cone in the axial direction. Since the curved wall surface of the second recess can guide the backflow flowing along the curved wall surface so as not to flow upstream, it is possible to suppress separation of the steam at the bearing cone.

(6) In some embodiments, in any one of the above configurations (1) to (5), the recess is disposed opposite to an exhaust chamber outlet through which a steam in the steam turbine exhaust chamber is discharged.

With the above configuration (6), the recess is disposed opposite to the exhaust chamber outlet through which the steam in the steam turbine exhaust chamber is discharged. Here, separation of the steam at the bearing cone hardly occurs on the side on which the exhaust chamber outlet for the steam in the exhaust chamber is disposed since the steam does not need to turn back upon impingement on the outer peripheral wall surface of the casing, unlike the opposite side on which the outer peripheral wall surface of the casing is disposed. Thus, by providing the recess on the opposite side with the outer peripheral wall surface of the casing, the backflow which turns back upon impingement on the outer peripheral wall surface of the casing on this side is guided by the recess. Thus, it is possible to prevent the backflow from flowing upstream of the bearing cone, and it is possible to suppress separation of the steam at the bearing cone.

(7) In some embodiments, in any one of the above configurations (1) to (6), the steam turbine exhaust chamber further comprises a first circulation flow guide extending outward in the radial direction from an inner peripheral portion of the recess.

With the above configuration (7), since the first circulation flow guide can guide the backflow flowing along the recess so as not to flow upstream, it is possible to suppress separation of the steam at the bearing cone.

(8) In some embodiments, in any one of the above configurations (1) to (7), the steam turbine exhaust chamber further comprises a second circulation flow guide extending inward in the radial direction from an outer peripheral portion of the recess.

With the above configuration (8), since the second circulation flow guide can guide the backflow flowing along the recess so as to circulate, it is possible to prevent the backflow from flowing upstream, and it is possible to suppress separation of the steam at the bearing cone.

(9) A steam turbine according to at least one embodiment of the present invention comprises: the steam turbine exhaust chamber described in any one of the above (1) to (8); a rotor blade disposed upstream of the steam turbine exhaust chamber; and a stator vane disposed upstream of the steam turbine exhaust chamber.

With the above configuration (9), since the steam turbine includes the steam turbine exhaust chamber with a configuration described in any one of the above (1) to (8), it is possible to reduce fluid loss in the exhaust chamber, and thus it is possible to improve the efficiency of the steam turbine.

(10) In some embodiments, in the above configuration (9), the steam turbine further comprises a condenser for condensing an exhaust steam discharged from the steam turbine exhaust chamber, and a position of the downstream end of the bearing cone in the axial direction coincides with a wall surface of the condenser.

With the above configuration (10), since the position of the downstream end of the bearing cone in the axial direction coincides with the wall surface of the condenser, the steam (exhaust steam) flowing downstream along the bearing cone on the side with the exhaust chamber outlet is guided into the condenser for condensing the steam. Thus, it is possible to reduce fluid loss in the exhaust chamber, and it is possible to improve the efficiency of the steam turbine.

Advantageous Effects

According to at least one embodiment of the present invention, there is provided a steam turbine exhaust chamber and a steam turbine whereby it is possible to reduce fluid loss in the exhaust chamber.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal". "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have". "contain" and "constitute" are not intended to be exclusive of other components.

First, an overall configuration of a steam turbine according to some embodiments will be described.

Figure 1:
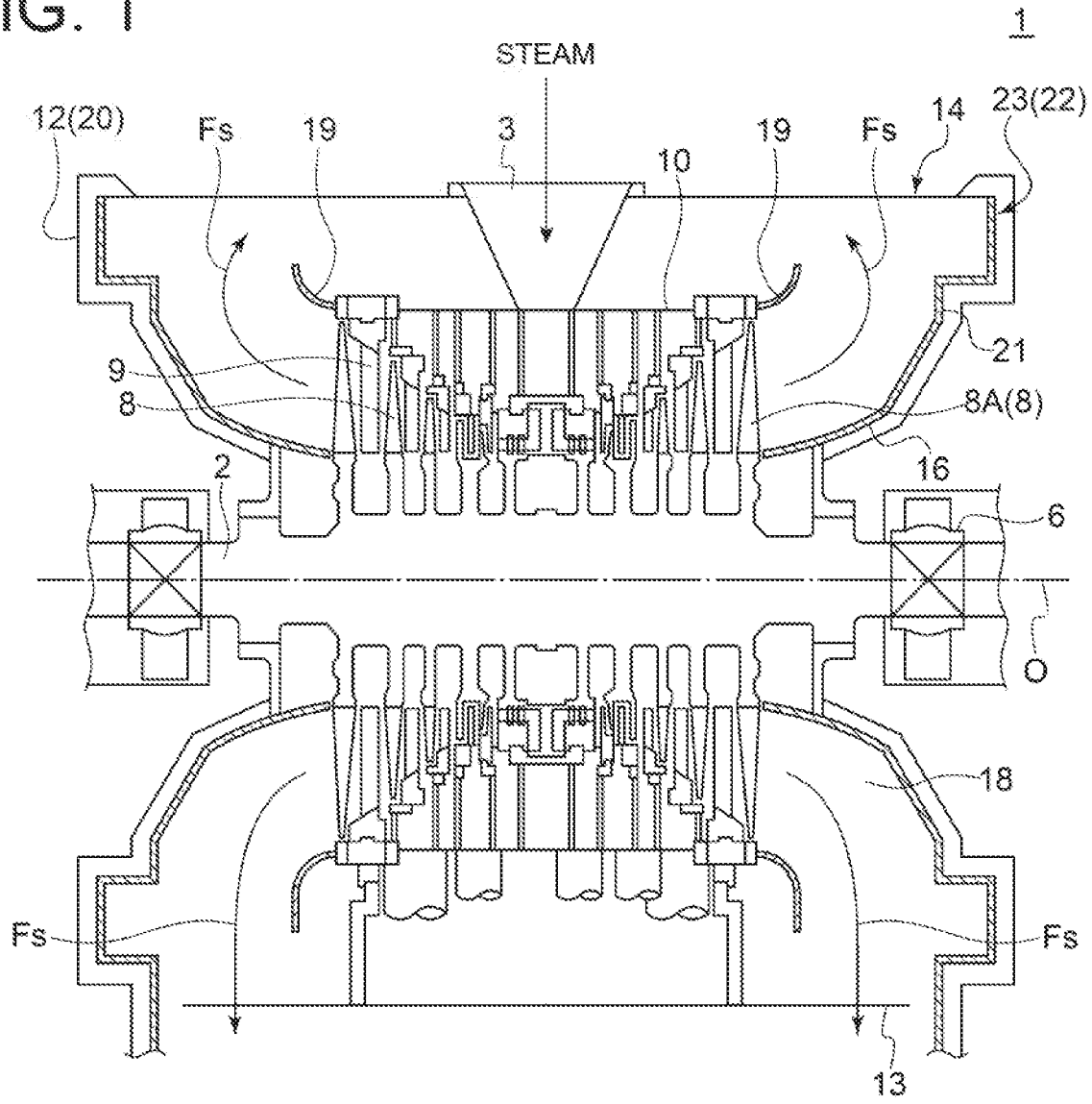
FIG. 1 is a schematic cross-sectional view of a steam turbine according to an embodiment of the present invention, taken along the axial direction.

FIG. 1 is a schematic cross-sectional view of a steam turbine according to an embodiment of the present invention, taken along the axial direction. As shown in FIG. 1, the steam turbine 1 includes a rotor 2 rotatably supported by a bearing 6, multiple stages of rotor blades 8 attached to the rotor 2, an inner casing 10 accommodating the rotor 2 and the rotor blades 8, and multiple stages of stator vanes 9 attached to the inner casing 10 so as to face the rotor blades 8. Additionally, an outer casing 12 is disposed outside the inner casing 10. In this steam turbine 1, steam introduced into the inner casing 10 from a steam inlet 3 is expanded and accelerated as the steam passes through the stator vanes 9. This steam acts on the rotor blades 8 to rotate the rotor 2.

The steam turbine 1 includes an exhaust chamber 14. As shown in FIG. 1, the exhaust chamber 14 is disposed downstream of the rotor blades 8 and the stator vanes 9. The steam (steam flow Fs) having passed through the rotor blades 8 and the stator vanes 9 in the inner casing 10 flows into the exhaust chamber 14 through an exhaust chamber inlet 11. The steam then passes through the interior of the exhaust chamber 14 and is discharged through an exhaust chamber outlet 13 disposed on a lower portion of the exhaust chamber 14 to the outside of the steam turbine 1. In some embodiments, a condenser 27 (see FIG. 6) is disposed below the exhaust chamber 14. In this case, the steam having acted on the rotor blades 8 in the steam turbine 1 flows from the exhaust chamber 14 to the condenser 27 through the exhaust chamber outlet 13.

Figure 2:
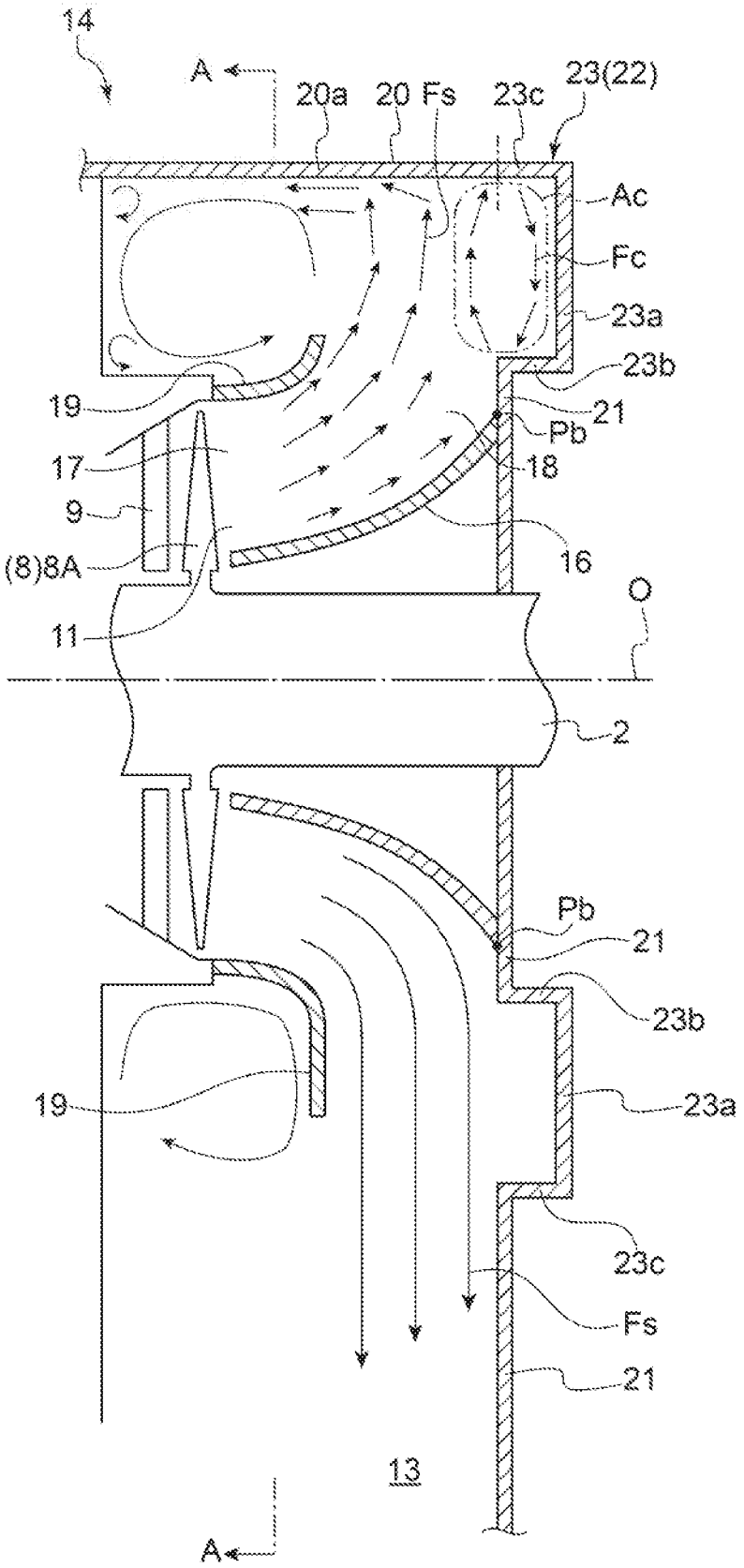
FIG. 2 is a schematic cross-sectional view of an exhaust chamber of a steam turbine according to an embodiment of the present invention, taken along the axial direction.
Figure 3:
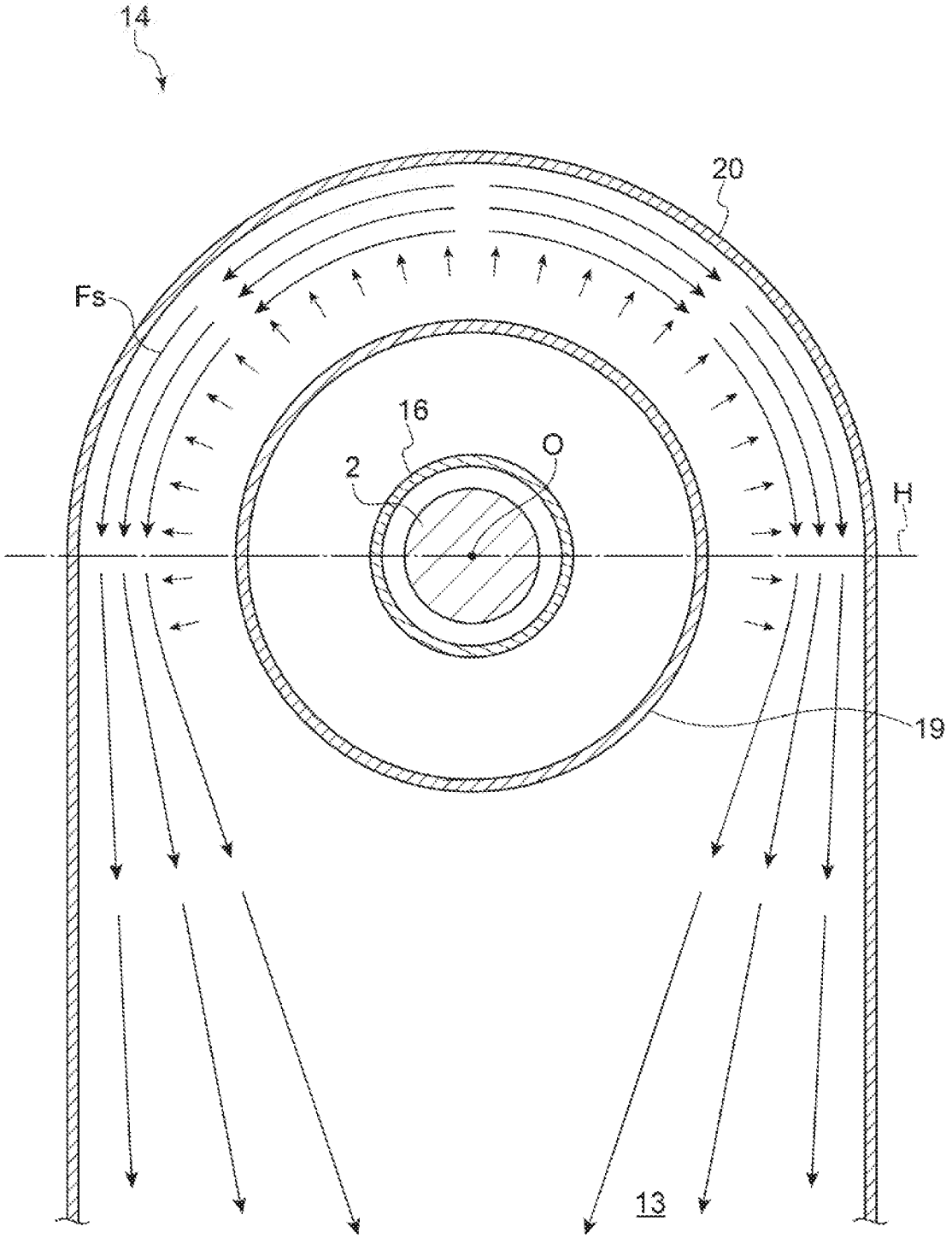
FIG. 3 is a schematic cross-sectional view taken along lines A-A in FIG. 2.
Figure 4:
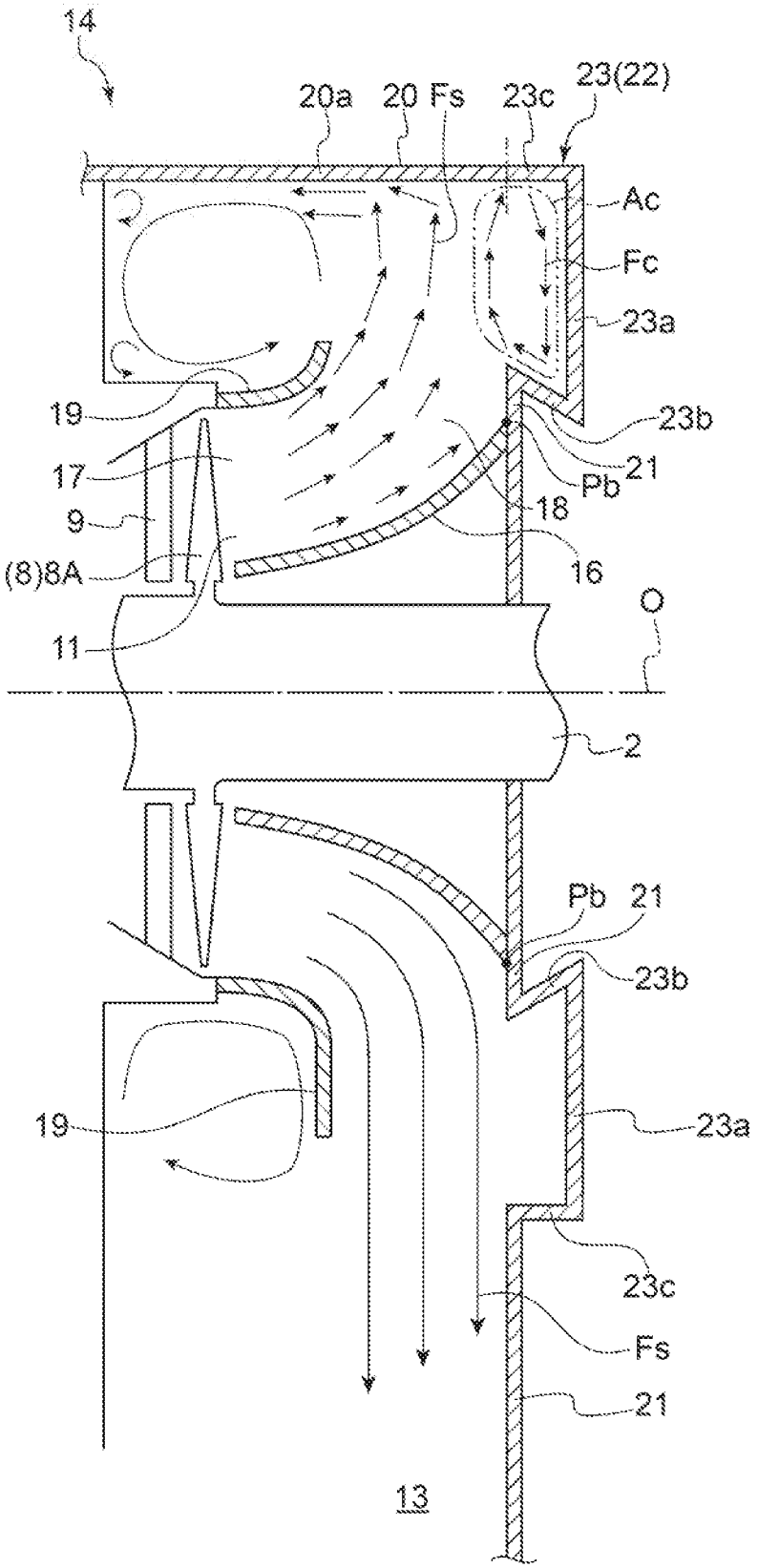
FIG. 4 is a schematic cross-sectional view of an exhaust chamber of a steam turbine according to another embodiment of the present invention, taken along the axial direction.
Figure 5:
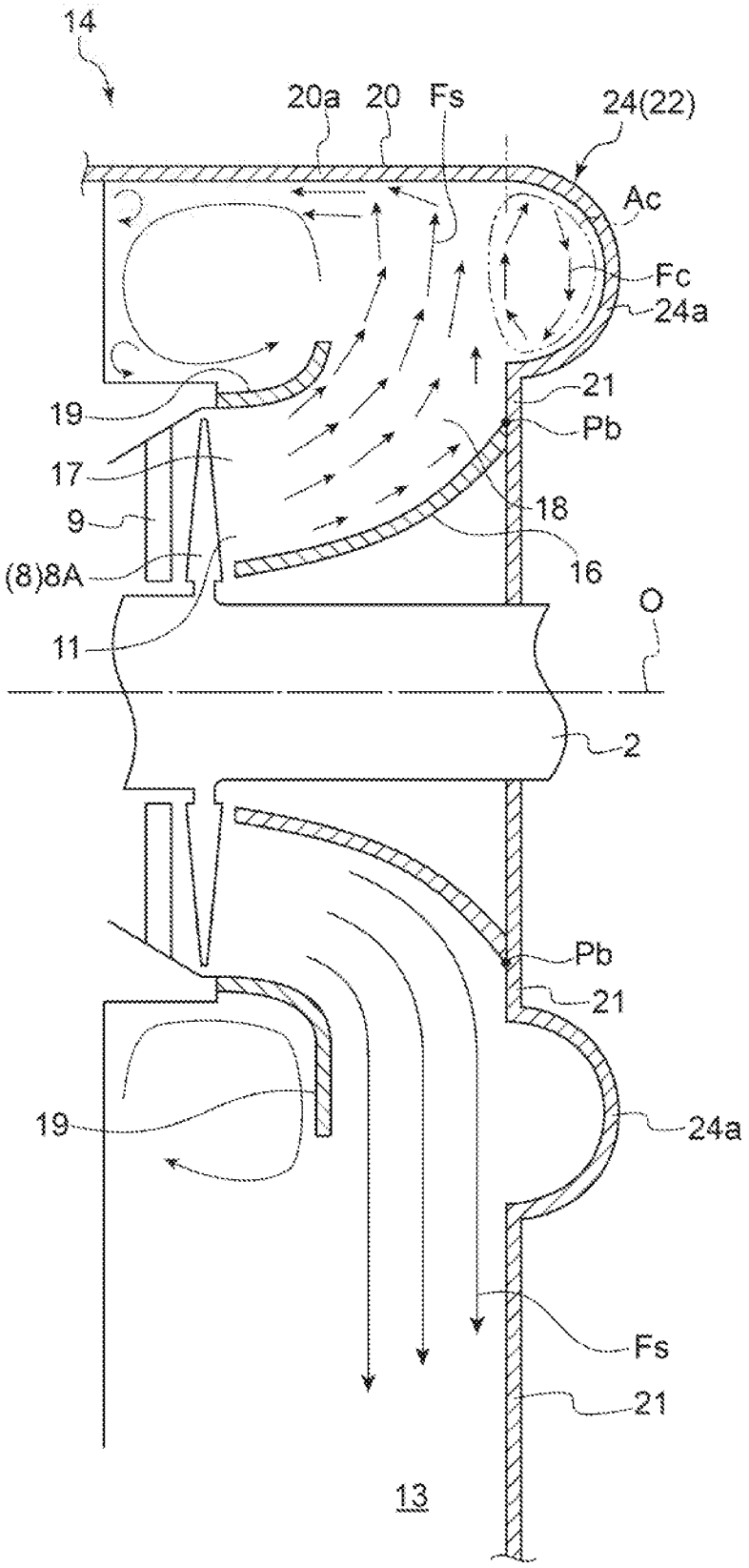
FIG. 5 is a schematic cross-sectional view of an exhaust chamber of a steam turbine according to another embodiment of the present invention, taken along the axial direction, for describing a second recess.
Figure 6:
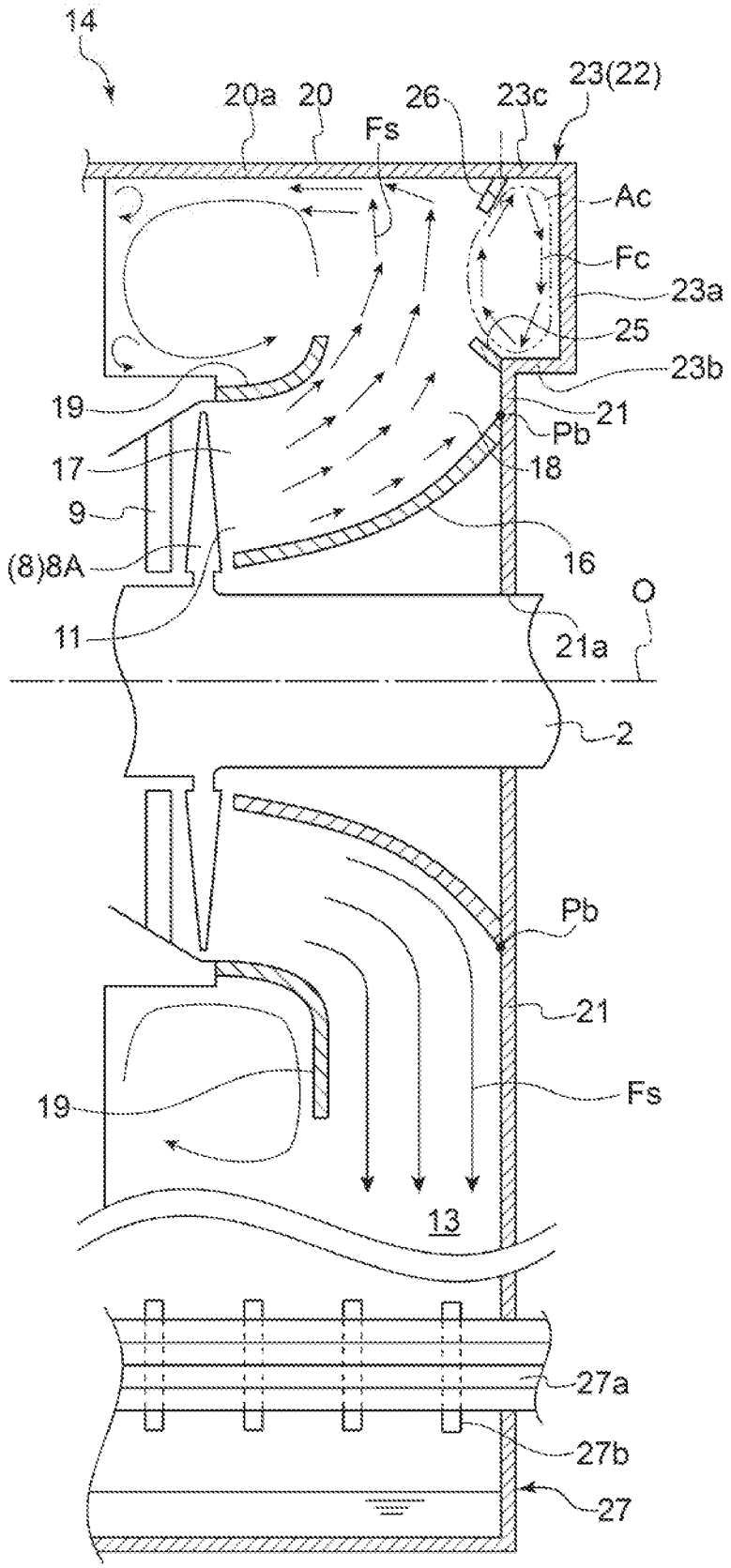
FIG. 6 is a schematic cross-sectional view of an exhaust chamber of a steam turbine according to another embodiment of the present invention, taken along the axial direction, for describing a first circulation flow guide, a second circulation flow guide, and a first wall surface.
Figure 7:
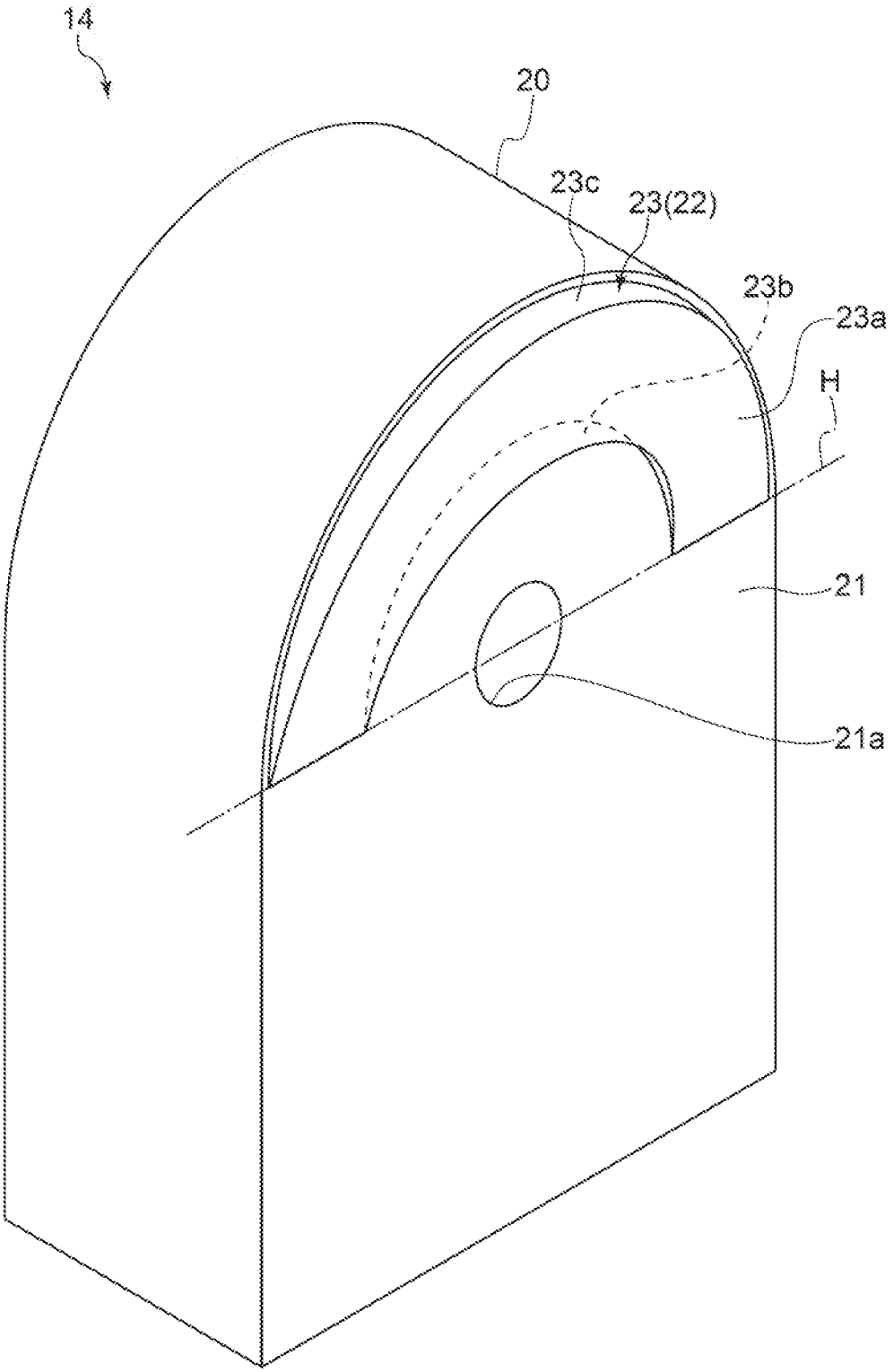
FIG. 7 is a schematic perspective view of an exhaust chamber of a steam turbine according to another embodiment of the present invention, where a casing is viewed from the outside.

Next, with reference to FIGS. 1 to 7, a configuration of the exhaust chamber 14 according to some embodiments will be described more specifically. FIG. 2 is a schematic cross-sectional view of an exhaust chamber of a steam turbine according to an embodiment of the present invention, taken along the axial direction. FIG. 3 is a schematic cross-sectional view taken along lines A-A in FIG. 2. FIG. 4 is a schematic cross-sectional view of an exhaust chamber of a steam turbine according to another embodiment of the present invention, taken along the axial direction. FIG. 5 is a schematic cross-sectional view of an exhaust chamber of a steam turbine according to another embodiment of the present invention, taken along the axial direction, for describing a second recess. FIG. 6 is a schematic cross-sectional view of an exhaust chamber of a steam turbine according to another embodiment of the present invention, taken along the axial direction, for describing a first circulation flow guide, a second circulation flow guide, and a first wall surface. FIG. 7 is a schematic perspective view of an exhaust chamber of a steam turbine according to another embodiment of the present invention, where a casing is viewed from the outside.

As shown in FIGS. 1 to 6, the exhaust chamber 14 according to some embodiments includes a casing 20, a bearing cone 16 disposed in the casing 20 so as to cover the bearing 6, and a flow guide 19 disposed on the radially outer side of the bearing cone 16 in the casing 20. As shown in FIG. 1, the casing 20 of the exhaust chamber 14 may form at least a part of the outer casing 12 of the steam turbine 1. Further, as shown in FIG. 2, etc., the central axes of the bearing cone 16 and the flow guide 19 may be on the same straight line as the central axis of the rotor 2.

A downstream end Pb of the bearing cone 16 is connected to an inner wall surface of the casing 20. More specifically, as shown in FIGS. 1, 2, and 4 to 6, the casing 20 has an outer peripheral wall surface 20*a* positioned on the outer side of the bearing cone 16 and the flow guide 19 in the radial direction (up-down direction in FIG. 2) and extending along the axial direction (right-left direction in FIG. 2) and a first wall surface 21 (radially inner wall surface) extending along the radial direction. As shown in FIGS. 2 and 4 to 6, at least a part of the first wall surface 21 is positioned on the radially outer side of the bearing cone 16, and an intermediate portion of the first wall surface 21 is connected to the downstream end Pb of the bearing cone 16. Further, the first wall surface 21 has a through hole 21*a* for receiving the rotor 2, as shown in FIGS. 4 to 7. As shown in FIG. 1, the radially inner end of the first wall surface 21 may be connected to the downstream end Pb of the bearing cone 16.

The exhaust chamber 14 has an exhaust chamber outlet 13 on the lower side. The steam flowing into the exhaust chamber 14 from the exhaust chamber inlet 11 is discharged from the steam turbine 1 through the exhaust chamber outlet 13. Further, as shown in FIG. 3, in the exhaust chamber 14, the outer peripheral wall surface 20*a* of the casing 20 on the upper side opposite to the lower side with the exhaust chamber outlet 13 across the horizontal line H has a semi-ring shape in a cross-section taken along an extension direction of the horizontal line H. The horizontal line H is a straight line extending along the horizontal direction (right-left direction in FIG. 3) perpendicular to the axis passing through the central axis O of the rotor 2.

The bearing cone 16 and the flow guide 19 together form an annular diffuser passage 18 (steam passage) inside the casing 20. The diffuser passage 18 communicates with a last-stage blade outlet 17 of the steam turbine 1 and is shaped such that the cross-sectional area increases gradually. When the steam flow Fs having passed through the last-stage rotor blade 8A of the steam turbine 1 at high speed flows into the diffuser passage 18 through the last-stage blade outlet 17, the speed of the steam flow Fs decreases, and its kinetic energy is converted to pressure (static pressure recovery).

The casing 20 in some embodiments further has a recess 22 provided along at least a part of the circumference in a radially outer portion of the first wall surface 21 and recessed downstream in the axial direction with respect to the first wall surface 21 as shown in FIGS. 1, 2, and 4 to 7. That is, the recess 22 is provided along at least a part of the circumference on the radially outer side of the downstream end Pb of the bearing cone 16 and is recessed downstream in the axial direction with respect to the downstream end Pb.

Figure 8:
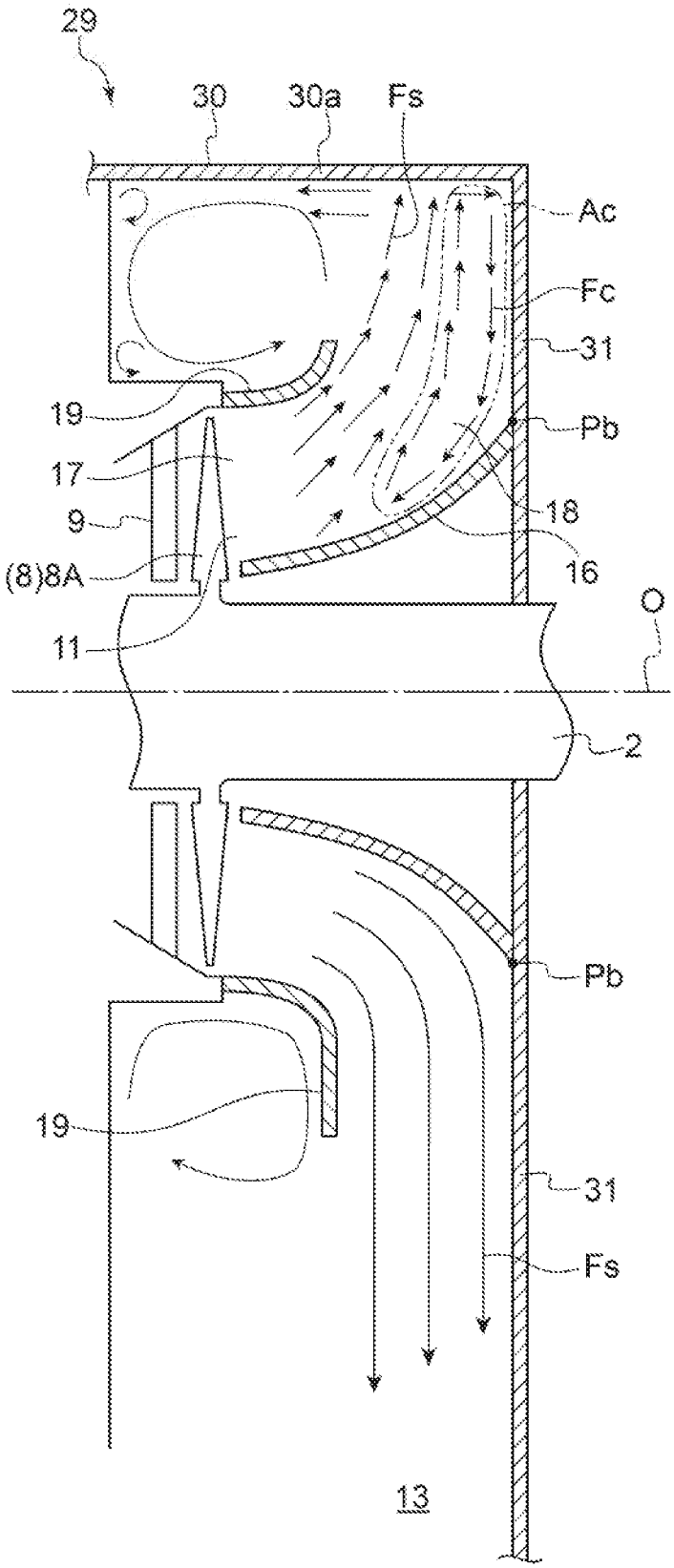
FIG. 8 is a schematic cross-sectional view of an exhaust chamber of a steam turbine according to a comparative example, taken along the axial direction.

FIG. 8 is a schematic cross-sectional view of an exhaust chamber of a steam turbine according to a comparative example, taken along the axial direction. In FIG. 8, members indicated by the same reference signs as in the embodiment shown in FIGS. 1 to 7 are not described.

The exhaust chamber 29 of the comparative example shown in FIG. 8 includes a casing 30, a bearing cone 16, and a flow guide 19. The casing 30 does not has the above-described recess 22. More specifically, as shown in FIG. 8, the casing 30 has an outer peripheral wall surface 30*a* positioned on the outer side of the bearing cone 16 and the flow guide 19 in the radial direction (up-down direction in the figure) and extending along the axial direction (right-left direction in the figure) and a first wall surface 31 extending along the radial direction. At least a part of the first wall surface 31 is positioned on the radially outer side of the bearing cone 16, and an intermediate portion of the first wall surface 31 is connected to the downstream end Pb of the bearing cone 16. Further, the radially outer end of the first wall surface 31 abuts on and is integrally connected to the axially downstream end of the outer peripheral wall surface 30*a*.

The present inventors have found that when the steam flow Fs is biased toward the flow guide 19, the exhaust chamber 29 of the comparative example including the casing 30 causes separation at the bearing cone 16, which increases fluid loss in the exhaust chamber 29. Here, the steam turbine 1 is designed so that the steam flows along the axial direction from the last-stage blade outlet 17 at normal operation. On the other hand, at low-load operation, the outflow speed of the steam decreases compared to normal operation although the rotational speed of the rotor blade 8 is not different from normal operation. Thus, the steam flowing from the last-stage blade outlet 17 at low-load operation has a large proportion of swirl component to axial component, and thus the flow is biased to the flow guide 19.

One of causes of the separation of the steam flow Fs at the bearing cone 16 is that a part of the steam flow Fs biased to the flow guide 19 impinges on the outer peripheral wall surface 30*a* and flows back as a backflow Fc flowing upstream along the bearing cone 16 positioned upstream of the first wall surface 31 and the first wall surface 31, as shown in FIG. 8. Since the backflow Fc in the exhaust chamber 29 is pushed back downstream by the steam flow Fs in the vicinity of the midstream of the bearing cone 16, the steam circulates near the bearing cone 16 and forms a circulation region Ac shown in FIG. 8. Further, since the circulation region Ac formed in the exhaust chamber 29 expands upstream of the downstream end Pb of the bearing cone 16, separation occurs at the bearing cone 16, and an effective exhaust area in the exhaust chamber 29 decreases. Consequently, fluid loss in the exhaust chamber 29 increases.

In view of this, the present inventors have arrived at forming the recess 22 on the casing 20 so that the recess 22 guides the backflow Fc to prevent it from flowing upstream of the bearing cone 16, thereby preventing separation of the steam at the bearing cone 16.

In some embodiments, the exhaust chamber 14 includes the casing 20 and the bearing cone 16, as shown in FIGS. 1 to 7. Further, the casing 20 has the recess 22, as shown in FIGS. 1, 2, and 4 to 7.

With the above configuration, in the exhaust chamber 14 of the steam turbine 1 including the casing 20 with the recess 22, even when the steam is biased to the flow guide 19 and forms the backflow Fc near the bearing cone 16 for instance at low-load operation, the recess 22 guides the backflow Fc. Thus, it is possible to prevent the backflow Fc from flowing upstream of the bearing cone 16, and it is possible to reduce expansion of the circulation region Ac, where circulation flow including the backflow Fc circulates, upstream of the downstream end Pb of the bearing cone 16. Thus, it is possible to suppress separation of the steam at the bearing cone 16 and prevent a decrease in effective exhaust area in the exhaust chamber 14, and it is possible to improve pressure recovery amount of the steam in the exhaust chamber 14. Consequently, it is possible to reduce fluid loss in the exhaust chamber 14, and it is possible to improve the efficiency of the steam turbine 1.

In some embodiments, the recess 22 includes a first recess 23, as shown in FIGS. 1, 2, 4, 6, and 7. As shown in FIGS. 2, 4, 6, and 7, the first recess 23 has a second wall surface 23*a* (radial wall surface) positioned downstream of the first wall surface 21 in the axial direction and extending parallel to the first wall surface 21 and a third wall surface 23*b* (axial wall surface) having a first end connected to the radially inner end of the second wall surface 23*a* and a second end connected to the radially outer end of the first wall surface 21. That is, the second wall surface 23*a* is positioned downstream of the downstream end Pb of the bearing cone 16 in the axial direction and extends along the radial direction, and the third wall surface 23*b* extends in a direction intersecting the radial direction from the first end to the second end.

Further, as shown in FIGS. 2, 4, 6, and 7, the first recess 23 further has a fourth wall surface 23*c* having a first end connected to the radially outer end of the second wall surface 23*a* and a second end connected to one end of the outer peripheral wall surface 20*a* of the casing 20. In some embodiments, as shown in FIGS. 2, 4, and 6, the second end of the fourth wall surface 23*c* is linearly connected and continuous with one end of the outer peripheral wall surface 20*a* in a cross-section taken along the axial direction. Alternatively, in some embodiments, as shown in FIG. 7, the second end of the fourth wall surface 23*c* is connected to one end of the outer peripheral wall surface 20*a* so as to form a step therebetween. Although in FIGS. 2, 4, and 6, the long-dashed double-dotted line separates the outer peripheral wall surface 20*a* and the fourth wall surface 23*c* for convenience of description, the outer peripheral wall surface 20*a* and the fourth wall surface 23*c* may be integrally formed.

With the above configuration, the first recess 23 has the second wall surface 23*a* extending along the radial direction on the downstream side of the downstream end Pb of the bearing cone 16 with respect to the axial direction and the third wall surface 23*b* connected at the first end to the radially inner end of the second wall surface 23*a* and extending in a direction intersecting the radial direction from the first end to the second end. Since such a third wall surface 23*b* can guide the backflow Fc flowing upstream along the second wall surface 23*a* so as not to flow further upstream, it is possible to suppress separation of the steam at the bearing cone 16.

In some embodiments, the third wall surface 23*b* is disposed along the axial direction, as shown in FIGS. 1, 2, 6, and 7.

More specifically, as shown in FIGS. 2 and 6, in a cross-section along the axial direction, the third wall surface 23*b* is formed so as to be bent from the radially inner end of the second wall surface 23*a* at a right angle with respect to the second wall surface 23*a*.

With the above configuration, since the third wall surface 23*b* is disposed along the axial direction, it is possible to guide the backflow Fc flowing upstream along the second wall surface 23*a* so as not to flow further upstream. Thus, it is possible to suppress separation of the steam at the bearing cone 16.

Further, in some embodiments, the first end of the third wall surface 23*b* is positioned on the radially inner side of the second end of the third wall surface 23*b*, as shown in FIG. 4.

More specifically, as shown in FIG. 4, in a cross-section along the axial direction, the third wall surface 23*b* is formed so as to be bent from the radially inner end of the second wall surface 23*a* at an acute angle with respect to the second wall surface 23*a*.

With the above configuration, since the first end of the third wall surface 23*b* connected to the radially inner end of the second wall surface 23*a* is positioned on the radially inner side of the second end, it is possible to more effectively guide the backflow Fc flowing upstream along the second wall surface 23*a* so as not to flow further upstream, compared with the case disposed along the axial direction of the first wall surface 21. Thus, it is possible to more effectively suppress separation of the steam at the bearing cone 16.

In some embodiments, the recess 22 includes a second recess 24, as shown in FIG. 5. The second recess 24 has a curved wall surface 24*a* which is curved and positioned downstream of the first wall surface 21 in the axial direction, as shown in FIG. 5.

More specifically, in some embodiments, as shown in FIG. 5, in a cross-section along the axial direction, a lower end of the curved wall surface 24*a* of the second recess 24 is positioned on the inner peripheral side and is connected to the radially outer end of the first wall surface 21 at a right angle, while an upper end of the curved wall surface 24*a* is positioned on the outer peripheral side and is linearly connected and continuous with one end of the outer peripheral wall surface 20*a*. Although in FIG. 5, the long-dashed double-dotted line separates the outer peripheral wall surface 20*a* and the curved wall surface 24*a* for convenience of description, the outer peripheral wall surface 20*a* and the curved wall surface 24*a* may be integrally formed. Moreover, in some embodiments, the second recess 24 has a curved wall surface 24*a* partially curved. Further, the second recess 24 has, besides the curved wall surface 24*a*, the third wall surface 23*b* connected to the first wall surface 21 and the fourth wall surface 23*c* connected the outer peripheral wall surface 20*a* as described above, and the curved wall surface 24*a* is connected to the third wall surface 23*b* and the fourth wall surface 23*c*.

With the above configuration, the second recess 24 has the curved wall surface 24*a* curved downstream of the first wall surface 21 in the axial direction. Since the curved wall surface 24*a* of the second recess 24 can guide the backflow Fc flowing along the curved wall surface 24*a* so as not to flow upstream, it is possible to suppress separation of the steam at the bearing cone 16.

In some embodiments, as shown in FIGS. 6 and 7, the recess 22 is disposed opposite to the exhaust chamber outlet 13 through which the steam in the exhaust chamber 14 is discharged.

More specifically, although the recess 22 in some embodiments described above is formed in a ring shape as shown in FIGS. 1, 2, 4, and 5, the recess 22 in this embodiment is shaped, as shown in FIGS. 6 and 7, in an arch shape (semi-ring shape in FIG. 7) along a part of the circumference, and the recess 22 is provided only on a side opposite to the exhaust chamber outlet 13 through which the steam in the exhaust chamber 14 is discharged. Moreover, in some embodiments, as shown in FIG. 7, the recess 22 is formed so that the depth of the recess 22 increases from the ends (lower ends in the figure) to the center (upper end in the figure) of the arc. The depth of the first recess 23 is defined by the length of the third wall surface 23*b* and the fourth wall surface 23*c*. Thus, the length of the third wall surface 23*b* and the fourth wall surface 23*c* of the first recess 23 is formed so as to increase from the ends to the center of the arc.

With the above configuration, the recess 22 is disposed opposite to the exhaust chamber outlet 13 through which the steam in the exhaust chamber 14 is discharged. Here, separation of the steam at the bearing cone 16 hardly occurs on the side on which the exhaust chamber outlet 13 for the steam in the exhaust chamber 14 is disposed since the steam does not need to turn back upon impingement on the outer peripheral wall surface 20*a* of the casing 20, unlike the opposite side on which the outer peripheral wall surface 20*a* of the casing 20 is disposed. Thus, by providing the recess 22 on the opposite side with the outer peripheral wall surface 20*a* of the casing 20, the backflow Fc which turns back upon impingement on the outer peripheral wall surface 20*a* of the casing 20 on this side is guided by the recess 22. Thus, it is possible to prevent the backflow Fc from flowing upstream of the bearing cone 16, and it is possible to suppress separation of the steam at the bearing cone 16.

In some embodiments, as shown in FIG. 6, the exhaust chamber 14 further includes a first circulation flow guide 25 extending radially outward from an inner peripheral portion of the recess 22.

As shown in FIG. 6, a first end of the first circulation flow guide 25 is connected to the third wall surface 23*b* positioned on an inner peripheral portion of the first recess 23, and a second end of the first circulation flow guide 25 extends radially outward (upward in the figure). Further, the first circulation flow guide 25 is oblique to the first wall surface 21. The first end of the first circulation flow guide 25 may be connected to an inner peripheral portion of the second recess 24, or the first end of the first circulation flow guide 25 may be connected to near the radially outer end of the first wall surface 21.

With the above configuration, since the first circulation flow guide 25 can guide the backflow Fc flowing along the recess 22 so as not to flow upstream, it is possible to suppress separation of the steam at the bearing cone 16.

In some embodiments, as shown in FIG. 6, the exhaust chamber 14 further includes a second circulation flow guide 26 extending radially inward from an outer peripheral portion of the recess 22.

As shown in FIG. 6, a first end of the second circulation flow guide 26 is connected to the fourth wall surface 23*c* positioned on an outer peripheral portion of the first recess 23, and a second end of the second circulation flow guide 26 extends radially inward (downward in the figure). Further, the second circulation flow guide 26 is oblique to the first wall surface 21. The first end of the second circulation flow guide 26 may be connected to an outer peripheral portion of the second recess 24, or the first end of the second circulation flow guide 26 may be connected to near the end of the outer peripheral wall surface 20*a* connected to the recess 22.

With the above configuration, since the second circulation flow guide 26 can guide the backflow Fc flowing along the recess 22 so as to circulate, it is possible to prevent the backflow Fc from flowing upstream, and it is possible to suppress separation of the steam at the bearing cone 16.

Further, in some embodiments, the steam turbine 1 includes the exhaust chamber 14 with a configuration described in any one of the above embodiments (see FIGS. 1 to 7). Further, as shown in FIGS. 1, 2, and 4 to 6, the steam turbine 1 includes a rotor blade 8 disposed upstream of the exhaust chamber 14 and a stator vane 9 disposed upstream of the exhaust chamber 14 likewise.

With the above configuration, since the steam turbine 1 includes the exhaust chamber 14 with a configuration described in any one of the above embodiments (see FIGS.

1 to 7), it is possible to reduce fluid loss in the exhaust chamber 14, and thus it is possible to improve the efficiency of the steam turbine 1.

In some embodiments, as shown in FIG. 6, the steam turbine 1 further includes a condenser 27 for condensing exhaust steam discharged from the exhaust chamber 14. Further, the first wall surface 21 of the exhaust chamber 14 is flushed with the wall surface of the condenser 27. That is, the position of the downstream end Pb of the bearing cone 16 in the axial direction coincides with the wall surface of the condenser 27.

As shown in FIG. 6, the condenser 27 has a plurality of cooling tubes 27*a* extending along the axial direction and support members 27*b* disposed in the middle of the length of the cooling tubes 27*a* at intervals and supporting the plurality of cooling tubes 27*a*. Further, the condenser 27 condenses the exhaust steam discharged from the exhaust chamber 14 by the plurality of cooling tubes 27*a*.

With the above configuration, since the position of the downstream end Pb of the bearing cone 16 in the axial direction coincides with the wall surface of the condenser 27, the steam (exhaust steam) flowing downstream along the bearing cone 16 on the side with the exhaust chamber outlet 13 is guided into the condenser 27 for condensing the steam. Thus, it is possible to reduce fluid loss in the exhaust chamber 14, and it is possible to improve the efficiency of the steam turbine 1.

Although in the above-described embodiments, the casing 20 has the first wall surface 21 and the recess 22, the casing 20 including only the recess 22 has the same effect as above.

Figure 9:
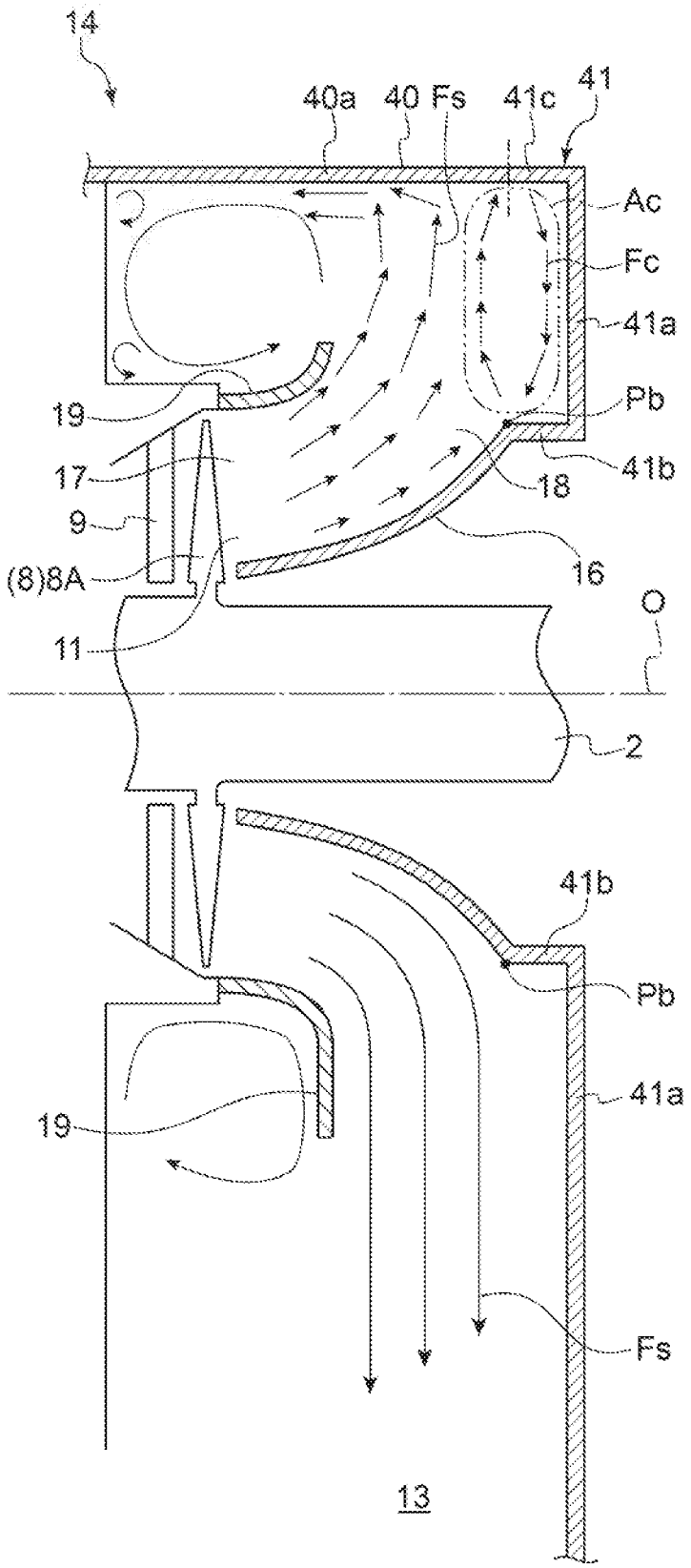
FIG. 9 is a schematic cross-sectional view of an exhaust chamber of a steam turbine according to another embodiment of the present invention, taken along the axial direction, for describing a casing not having a first wall surface.

FIG. 9 is a schematic cross-sectional view of an exhaust chamber of a steam turbine according to another embodiment of the present invention, taken along the axial direction, for describing a casing not having a first wall surface. As shown in FIG. 9, a casing 40 is different from the casing 20 in that it does not have the first wall surface 21. In the following, the same features as those of the exhaust chamber 14 are denoted by the same reference signs, and description thereof will be omitted. The characteristic features of the casing 40 will be mainly described below.

In some embodiments, as shown in FIG. 9, the casing 40 has a recess 41 provided along at least a part of the circumference on the radially outer side of the downstream end Pb of the bearing cone 16 and recessed downstream in the axial direction with respect to the downstream end Pb. In the embodiment shown in FIG. 9, the casing 40 further has an outer peripheral wall surface 40*a* positioned on the outer side of the bearing cone 16 and the flow guide 19 in the radial direction (up-down direction in FIG. 9) and extending along the axial direction (right-left direction in FIG. 9). The casing 40 may form at least a part of the outer casing 12 of the steam turbine 1, like the casing 20.

With the above configuration, in the exhaust chamber 14 of the steam turbine 1 including the casing 40 with the recess 41, even when the steam is biased to the flow guide 19 and forms the backflow Fc near the bearing cone 16 for instance at low-load operation, the recess 41 guides the backflow Fe. Thus, it is possible to prevent the backflow Fc from flowing upstream of the bearing cone 16, and it is possible to reduce expansion of the circulation region Ac, where circulation flow including the backflow Fc circulates, upstream of the downstream end Pb of the bearing cone 16. Thus, it is possible to suppress separation of the steam at the bearing cone 16 and prevent a decrease in effective exhaust area in the exhaust chamber 14, and it is possible to improve pressure recovery amount of the steam in the exhaust chamber 14. Consequently, it is possible to reduce fluid loss in the exhaust chamber 14, and it is possible to improve the efficiency of the steam turbine 1.

In some embodiments, as shown in FIG. 9, the recess 41 has a second wall surface 41*a* (radial wall surface) positioned downstream of the downstream end Pb of the bearing cone 16 in the axial direction and extending along the radial direction and a third wall surface 41*b* (axial wall surface) connected at a first end to the radially inner end of the second wall surface 41*a* and extending in a direction intersecting the radial direction from the first end to a second end. Although in the embodiment shown in FIG. 9, the third wall surface 41*b* extends along the axial direction, in some embodiments, the third wall surface 41*b* may extend in a direction oblique to the axial direction, and the first end of the third wall surface 41*b* may be positioned on the radially outer side or inner side of the second end. Further, in the embodiment shown in FIG. 9, the radially inner end of the recess 41, i.e., the second end of the third wall surface 41*b* is connected to the downstream end Pb of the bearing cone 16.

In the embodiment shown in FIG. 9, the recess 41 is annularly formed. Further, the recess 41 further has a fourth wall surface 41*c* disposed along at least a part of the circumference. The fourth wall surface 41*c* is disposed opposite to the exhaust chamber outlet 13 through which the steam in the exhaust chamber 14 is discharged, and has a first end connected to the radially outer end of the second wall surface 41*a* and a second end connected to one end of the outer peripheral wall surface 40*a* of the casing 40. Although in FIG. 9, the long-dashed double-dotted line separates the outer peripheral wall surface 40*a* and the fourth wall surface 41*c* for convenience of description, the outer peripheral wall surface 40*a* and the fourth wall surface 41*c* may be integrally formed.

Further, the axial position of the second wall surface 41*a* in the embodiment shown in FIG. 9 may coincide with the wall surface (see FIG. 6) of the condenser 27. More specifically, for instance in the embodiments shown in FIGS. 2 and 4, on the side with the exhaust chamber outlet 13, the second wall surface 23*a* is connected to the first end of the fourth wall surface 23*c* at the radially outer end. That is, the second wall surface 23*a* does not extend toward the exhaust chamber outlet 13 beyond the portion connected to the fourth wall surface 23*c*. Instead, the first wall surface 21 connected to the second end of the fourth wall surface 23*c* extend toward the exhaust chamber outlet 13 from the portion connected to the fourth wall surface 23*c*. By contrast, in the embodiment shown in FIG. 9, on the side with the exhaust chamber outlet 13, the second wall surface 41*a* is not connected to the fourth wall surface 23*c* as shown in FIGS. 2 and 4, but extends toward the exhaust chamber outlet 13. Further, the radially outer end of the second wall surface 41*a* is linearly connected and continuous with one end (radially inner end) of the wall surface of the condenser 27. The second wall surface 41*a* is flushed with the wall surface of the condenser 27 without forming a step therebetween.

With the above configuration, the recess 41 has the second wall surface 41*a* extending along the radial direction on the downstream side of the downstream end Pb of the bearing cone 16 with respect to the axial direction and the third wall surface 41*b* connected at the first end to the radially inner end of the second wall surface 41*a* and extending in a direction intersecting the radial direction from the first end to the second end. Since such a third wall surface 41*b* can guide the backflow Fc flowing upstream along the second wall surface 41*a* so as not to flow further upstream, it is possible to suppress separation of the steam at the bearing cone 16.

The present invention is not limited to the embodiments described above, but includes modifications to the embodiments described above, and embodiments composed of combinations of those embodiments.

REFERENCE SIGNS LIST

1 Steam turbine
2 Rotor
3 Steam inlet
6 Bearing
8 Rotor blade
8A Last-stage rotor blade
9 Stator vane
10 Inner casing
11 Exhaust chamber inlet
12 Outer casing
13 Exhaust chamber outlet
14 Exhaust chamber
16 Bearing cone
17 Last-stage blade outlet
18 Diffuser passage
19 Flow guide
20 Casing
20*a* Outer peripheral wall surface
21 First wall surface
22 Recess
23 First recess
23*a* Second wall surface
23*b* Third wall surface
23*c* Fourth wall surface
24 Second recess
24*a* Curved wall surface
25 First circulation flow guide
26 Second circulation flow guide
27 Condenser
27*a* Cooling tube
27*b* Support member
29 Exhaust chamber
30 Casing
30*a* Outer peripheral wall surface
31 First wall surface
40 Casing
40*a* Outer peripheral wall surface
41 Recess
41*a* Second wall surface
41*b* Third wall surface
41*c* Fourth wall surface
Ac Circulation region
Fc Backflow
Fs Steam flow
H Horizontal line
O Central axis
Pb Downstream end of bearing cone

The invention claimed is:

1. A steam turbine exhaust chamber comprising: a casing; and a bearing cone disposed in the casing, wherein the casing has a recess provided along at least a part of a circumference of the casing on a radially outer side of a downstream end of the bearing cone and recessed downstream in an axial direction with respect to the downstream end of the bearing cone, wherein the recess includes a first recess having:

a radial wall surface positioned downstream of the downstream end of the bearing cone in the axial direction and extending along a radial direction; and an axial wall surface connected at a first end to a radially inner end of the radial wall surface and extending in a direction intersecting the radial direction from the first end to a second end.

2. The steam turbine exhaust chamber according to claim 1, wherein the axial wall surface is disposed along the axial direction.

3. The steam turbine exhaust chamber according to claim 1, wherein the first end of the axial wall surface is positioned on an inner side of the second end of the axial wall surface in the radial direction.

4. A steam turbine exhaust chamber comprising:

a casing; and a bearing cone disposed in the casing, wherein the casing has a recess provided along at least a part of a circumference of the casing on a radially outer side of a downstream end of the bearing cone and recessed downstream in an axial direction with respect to the downstream end of the bearing cone, wherein the recess includes a second recess having a curved wall surface curved and positioned downstream of the downstream end of the bearing cone in the axial direction.

5. The steam turbine exhaust chamber according to claim 1, wherein the recess is disposed opposite to an exhaust chamber outlet through which a steam in the steam turbine exhaust chamber is discharged.

6. A steam turbine exhaust chamber comprising:

a casing; and a bearing cone disposed in the casing, wherein the casing has a recess provided along at least a part of a circumference of the casing on a radially outer side of a downstream end of the bearing cone and recessed downstream in an axial direction with respect to the downstream end of the bearing cone, wherein the steam turbine exhaust chamber further comprises a first circulation flow guide extending outward in the radial direction from an inner peripheral portion of the recess.

7. A steam turbine exhaust chamber comprising: a casing; and a bearing cone disposed in the casing, wherein the casing has a recess provided along at least a part of a circumference of the casing on a radially outer side of a downstream end of the bearing cone and recessed downstream in an axial direction with respect to the downstream end of the bearing cone, wherein the stream turbine exhaust chamber further comprises a second circulation flow guide extending inward in the radial direction from an outer peripheral portion of the recess.

8. A steam turbine comprising:

the steam turbine exhaust chamber according to claim 1;

a rotor blade disposed upstream of the steam turbine exhaust chamber; and a stator vane disposed upstream of the steam turbine exhaust chamber.

9. The steam turbine according to claim 8, further comprising a condenser for condensing an exhaust steam discharged from the steam turbine exhaust chamber, wherein a position of the downstream end of the bearing cone in the axial direction coincides with a wall surface of the condenser.

10. The steam turbine exhaust chamber according to claim 4, wherein the recess is disposed opposite to an exhaust chamber outlet through which a steam in the steam turbine exhaust chamber is discharged.

11. The steam turbine exhaust chamber according to claim 6, wherein the recess is disposed opposite to an exhaust chamber outlet through which a steam in the steam turbine exhaust chamber is discharged.

12. The steam turbine exhaust chamber according to claim 7, wherein the recess is disposed opposite to an exhaust chamber outlet through which a steam in the steam turbine exhaust chamber is discharged.

13. A steam turbine comprising:

the steam turbine exhaust chamber according to claim 4;

a rotor blade disposed upstream of the steam turbine exhaust chamber; and a stator vane disposed upstream of the steam turbine exhaust chamber.

14. The steam turbine according to claim 13, further comprising a condenser for condensing an exhaust steam discharged from the steam turbine exhaust chamber, wherein a position of the downstream end of the bearing cone in the axial direction coincides with a wall surface of the condenser.

15. A steam turbine comprising:

the steam turbine exhaust chamber according to claim 6;

a rotor blade disposed upstream of the steam turbine exhaust chamber; and a stator vane disposed upstream of the steam turbine exhaust chamber.

16. The steam turbine according to claim 15, further comprising a condenser for condensing an exhaust steam discharged from the steam turbine exhaust chamber, wherein a position of the downstream end of the bearing cone in the axial direction coincides with a wall surface of the condenser.

17. A steam turbine comprising:

the steam turbine exhaust chamber according to claim 7;

a rotor blade disposed upstream of the steam turbine exhaust chamber; and a stator vane disposed upstream of the steam turbine exhaust chamber.

18. The steam turbine according to claim 17, further comprising a condenser for condensing an exhaust steam discharged from the steam turbine exhaust chamber, wherein a position of the downstream end of the bearing cone in the axial direction coincides with a wall surface of the condenser.

* * * * *